US010370211B1

(12) United States Patent
Yang et al.

(10) Patent No.: US 10,370,211 B1
(45) Date of Patent: Aug. 6, 2019

(54) PAPER SIZE DETECTION MODULE

(71) Applicant: Primax Electronics Ltd., Taipei (TW)

(72) Inventors: Chao-Min Yang, Taipei (TW); Chih-Chia Lee, Taipei (TW)

(73) Assignee: PRIMAX ELECTRONICS LTD, Taipei (TW)

( * ) Notice: Subject to any disclaimer, the term of this patent is extended or adjusted under 35 U.S.C. 154(b) by 0 days.

(21) Appl. No.: 15/962,610

(22) Filed: Apr. 25, 2018

(30) Foreign Application Priority Data

Jan. 19, 2018 (TW) ..... 107102088 A

(51) Int. Cl.
*B65H 1/04* (2006.01)
*B65H 7/02* (2006.01)

(52) U.S. Cl.
CPC ..... *B65H 7/02* (2013.01); *B65H 1/04* (2013.01); *B65H 2405/1142* (2013.01); *B65H 2511/12* (2013.01)

(58) Field of Classification Search
CPC ..... B65H 1/00; B65H 2405/00; B65H 2405/1116; B65H 2405/112; B65H 2405/113; B65H 2405/114; B65H 2511/10; B65H 2511/12; B65H 2701/1131; B65H 1/04
See application file for complete search history.

(56) References Cited

U.S. PATENT DOCUMENTS 5,110,106 A * 5/1992 Matsumura ..... B65H 7/02 271/171
5,343,142 A * 8/1994 Sasaki ..... B65H 1/00 324/691
7,285,965 B2 * 10/2007 Shen ..... B65H 1/04 324/716
7,348,547 B2 * 3/2008 Ando ..... B41J 11/003 250/231.13
2003/0151188 A1 * 8/2003 Imahara ..... B65H 1/00 271/171
2011/0133393 A1 * 6/2011 Okamoto ..... B65H 3/0607 271/167
2012/0026561 A1 * 2/2012 Lu ..... B65H 1/00 358/498

FOREIGN PATENT DOCUMENTS

JP 201122455 * 2/2011

* cited by examiner

*Primary Examiner* — Thomas A Morrison
(74) *Attorney, Agent, or Firm* — Kirton McConkie; Evan R. Witt

(57) ABSTRACT

A paper size detection module includes a position sensing assembly and a sliding block assembly. The position sensing assembly is installed on a bottom side of a paper supporting plate. The position sensing assembly includes a carrier plate, a sensing circuit board and plural elastomers. The first ends of the elastomers are connected with the sensing circuit board. The second ends of the elastomers are protruded out of the carrier plate and have corresponding pressed surfaces. The sliding block assembly includes a paper positioning block and at least one roller. The paper positioning block is installed on the paper supporting plate. The roller is connected with the paper positioning block and rolled along the carrier plate. When a position of the pressed surface rolled and pressed by the roller is detected, the sensing circuit board generates a paper size signal.

12 Claims, 4 Drawing Sheets

PAPER SIZE DETECTION MODULE

FIELD OF THE INVENTION

The present invention relates to a paper size detection module, and more particularly to a paper size detection module that is installed on a paper supporting plate.

BACKGROUND OF THE INVENTION

As known, people usually need to copy paper documents in daily lives or in working places. Generally, the paper document to be printed is placed in a paper input platform. At the time when the paper document is fed into the inner portion of a printer or a copier, the printer or the copier detects the width of the paper document. According to the width of the paper document, the printer or the copier selects the print paper with a suitable size from a paper input tray. Then, the contents of the paper document are printed out and printed on the print paper.

Conventionally, the sensors for measuring the paper width paper are installed within the paper input platform of the printer or the copier. For example, the sensors are infrared sensors, pressure sensors or any other appropriate optical sensors. Since sensors are power-consuming, the printer or the copier has to provide a lot of electric power to the sensors. For allowing the sensors to successfully detect the paper width, the problem of wasting electric power occurs.

Moreover, since the sensors are installed within the paper input platform of the printer or the copier, the paper input platform needs to have the corresponding structures for installing the sensors. Generally, the sensors are only able to detect limited number of paper width sizes. For accurately detecting different paper width sizes, it is necessary to install many sensors within the paper input platform. Under this circumstance, the inner structure of the paper input platform is complicated. Moreover, since the sensors are bulky, the sensors occupy much inner space of the paper input platform. In other words, the conventional paper size detection device is detrimental to miniaturization of the product.

SUMMARY OF THE INVENTION

The present invention provides a paper size detection module.

In accordance with an aspect of the present invention, there is provided a paper size detection module. The paper size detection module is installed on a paper supporting plate. The paper size detection module includes a position sensing assembly and a sliding block assembly. The position sensing assembly is located under the paper supporting plate, and includes a carrier plate, a sensing circuit board and plural elastomers. The sensing circuit board is installed on a bottom side of the carrier plate. The first ends of the elastomers are connected with the sensing circuit board. The second ends of the elastomers are protruded out of the carrier plate and have corresponding pressed surfaces. The sliding block assembly includes a paper positioning block and at least one roller. The paper positioning block is installed on the paper supporting plate. The roller is located under the paper positioning block and the paper supporting plate. The roller is connected with the paper positioning block and rolled along the carrier plate. While the paper positioning block is moved, the roller is correspondingly rolled along the carrier plate and the pressed surfaces of the elastomers. When a position of the pressed surface rolled and pressed by the roller is detected, the sensing circuit board generates a paper size signal. Consequently, the function of detecting the width size of the paper is achieved.

In an embodiment, the sliding block assembly further includes a sliding track, and the sliding track is slidably connected between the paper supporting plate and the carrier plate. A bottom side of the paper positioning block is connected with a side of the sliding track. The roller is pivotally coupled to the sliding track. Consequently, the roller is pivotally coupled to the paper positioning block through the sliding track. As the paper positioning block is moved, the roller is correspondingly rolled through the sliding track. In an embodiment, the paper positioning block includes a supporting slab and a vertical positioning plate. The vertical positioning plate is protruded upwardly from the supporting slab. The supporting slab is connected with the sliding track. Consequently, the purpose of saving the material cost is achieved.

In an embodiment, the sliding block assembly further includes plural fixing elements. The fixing elements are penetrated through the sliding track and the supporting slab. Consequently, the supporting slab is fixed on the sliding track through the fixing elements. Preferably, the sliding block assembly further includes plural protrusion posts, and the plural protrusion posts are protruded from a bottom surface of the supporting slab. The paper supporting plate has a sliding slot. The protrusion posts are penetrated through the sliding slot and movable along the sliding slot. The fixing elements are tightened into the corresponding protrusion posts. Consequently, the sliding track and the supporting slab are connected with each other.

In an embodiment, the sliding block assembly further includes a ratchet, and the ratchet is pivotally coupled to the paper supporting plate and located under the paper supporting plate. Moreover, plural teeth are formed on a lateral surface of the sliding track, and the teeth of the sliding track are engaged with the ratchet. In an embodiment, a ring-shaped raised structure is protruded from an outer surface of a side of the ratchet away from the paper supporting plate, and a bottom surface of the sliding track is contacted with the ring-shaped raised structure.

In an embodiment, the position sensing assembly further includes a resilience plate, and the resilience plate is clamped between the sensing circuit board and the carrier plate. The plural elastomers are protruded from the resilience plate. The plural elastomers are connected with the sensing circuit board through the resilience plate. Preferably, the carrier plate has plural perforations. The plural elastomers are penetrated through and protruded out of the corresponding perforations, so that the pressed surfaces are exposed outside a top side of the carrier plate. In such ways, the elastomers are not detached.

In an embodiment, the position sensing assembly further includes plural fastening elements. The plural fastening elements are penetrated through the sensing circuit board, the resilience plate and the carrier plate sequentially. Preferably, the resilience plate and the plural elastomers are integrally formed. Moreover, the resilience plate and the plural elastomers are made of rubber, silicone or casting polyurethane. Preferably, the plural elastomers are aligned with the corresponding perforations, and the plural elastomers and the plural perforations are linearly arranged.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
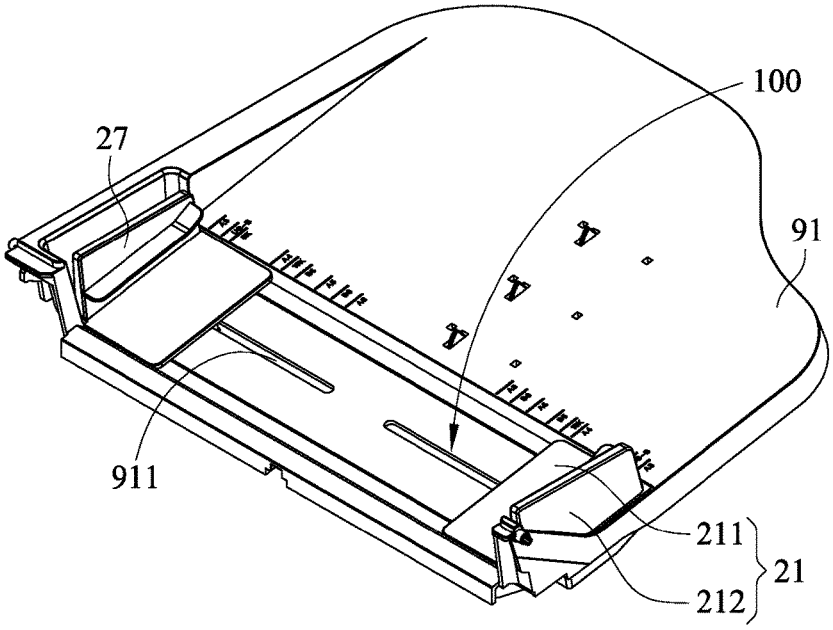
FIG. 1 is a schematic perspective view illustrating a portion of a paper size detection module according to an embodiment of the present invention.
Figure 2:
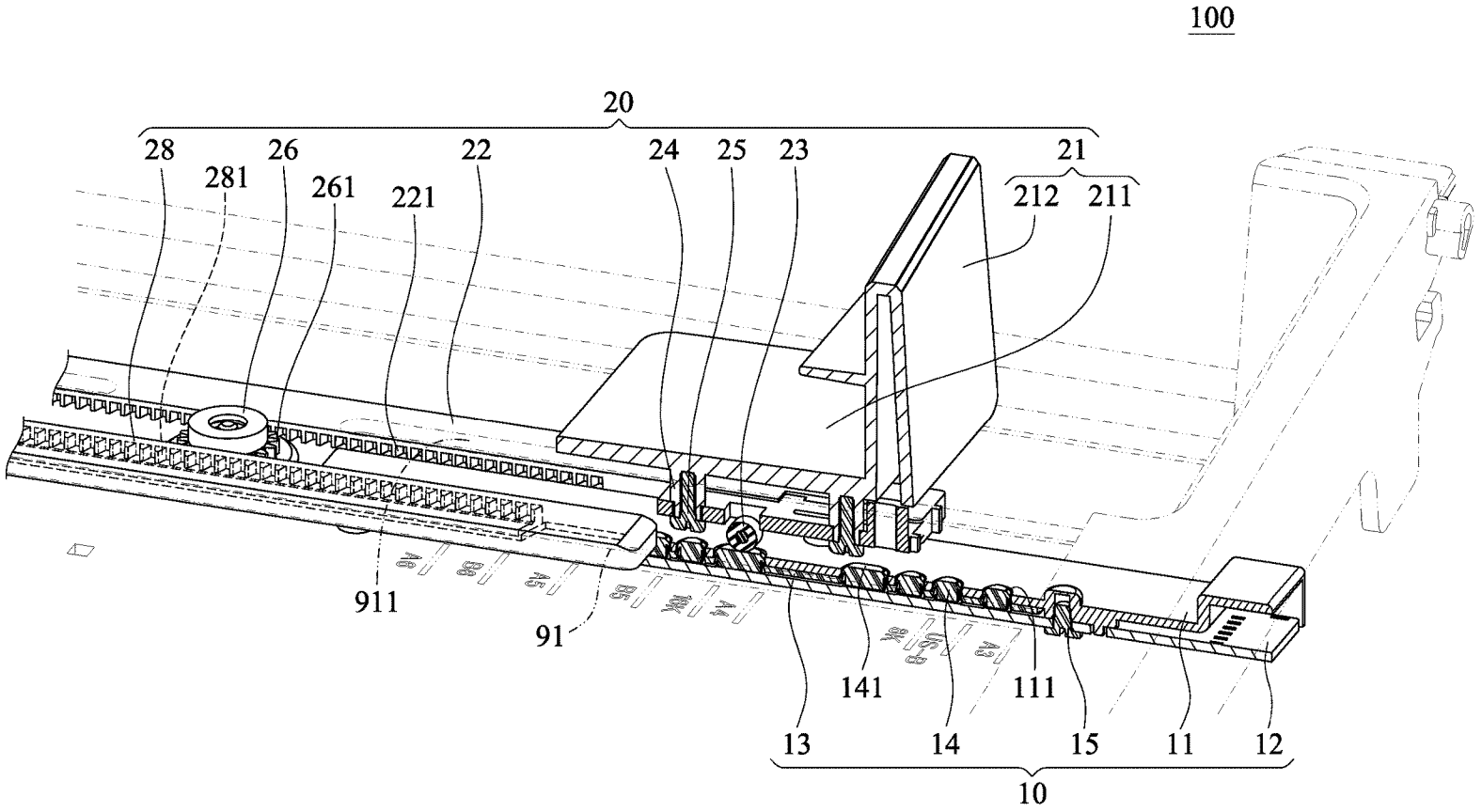
FIG. 2 is a schematic cutaway view illustrating a portion of the paper size detection module according to the embodiment of the present invention.
Figure 3:
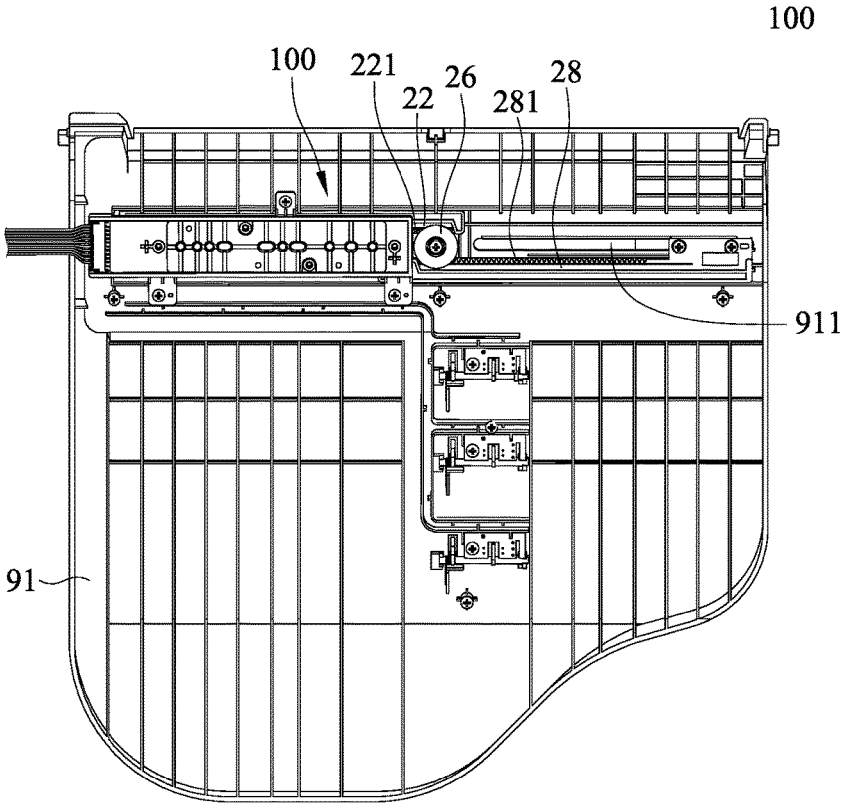
FIG. 3 is a schematic bottom view illustrating the paper size detection module according to the embodiment of the present invention.

FIG. 1 is a schematic perspective view illustrating a portion of a paper size detection module according to an embodiment of the present invention. FIG. 2 is a schematic cutaway view illustrating a portion of the paper size detection module according to the embodiment of the present invention. FIG. 3 is a schematic bottom view illustrating the paper size detection module according to the embodiment of the present invention. As shown in FIGS. 1, 2 and 3, the paper size detection module 100 is installed on a paper input platform 90 of a copier or a printer. The paper input platform 90 comprises a paper supporting plate 91. The paper supporting plate 91 has two sliding slots 911. The paper size detection module 100 comprises a position sensing assembly 10 and a sliding block assembly 20.

The position sensing assembly 10 is located under the paper supporting plate 91 and aligned with one sliding slot 911 of the paper supporting plate 91. The position sensing assembly 10 comprises a carrier plate 11, a sensing circuit board 12, a resilience plate 13, plural elastomers 14 and plural fastening elements 15. The carrier plate 11 is located beside the paper supporting plate 91. Moreover, the carrier plate 11 comprises plural perforations 111. The plural perforations 111 are formed in the carrier plate 11 in a linear arrangement. The sensing circuit board 12 is installed on a bottom side of the carrier plate 11. An example of the sensing circuit board 12 includes but is not limited to a pressure sensor board. The resilience plate 13 is clamped between the sensing circuit board 12 and the carrier plate 11. The plural elastomers 14 are extended from the resilience plate 13. Especially, the plural elastomers 14 are disposed on the resilience plate 13 in a linear arrangement. The elastomers 14 are aligned with the corresponding perforations 111. A first end of each elastomer 14 is coupled to the resilience plate 13 and contacted with the sensing circuit board 12 through the resilience plate 13. A second end of each elastomer 14 is arranged away from the resilience plate 13 and has a pressed surface 141. The plural elastomers 14 are penetrated through the corresponding perforations 111 of the carrier plate 11. Moreover, the pressed surfaces 141 are protruded out of the carrier plate 11 and exposed outside a top side of the carrier plate 11. In an embodiment, the resilience plate 13 and the plural elastomers 14 are integrally formed. Preferably, the resilience plate 13 and the plural elastomers 14 are made of rubber, silicone or casting polyurethane. After the fastening elements 15 are tightened into the sensing circuit board 12, the resilience plate 13 and the carrier plate 11 sequentially, the sensing circuit board 12, the resilience plate 13 and the carrier plate 11 are combined together. Consequently, the resilience plate 13 is securely clamped between the carrier plate 11 and the sensing circuit board 12.

The sliding block assembly 20 comprises a paper positioning block 21, a sliding track 22, at least one roller 23, plural protrusion posts 24, plural fixing elements 25, a ratchet 26, a linked positioning block 27 and a linked sliding track 28. The paper positioning block 21 is installed on a first side of the paper supporting plate 91 and located over the carrier plate 11. The paper positioning block 21 comprises a supporting slab 211 and a vertical positioning plate 212. The vertical positioning plate 212 is protruded upwardly from the supporting slab 211. The plural protrusion posts 24 are protruded from a bottom surface of the paper positioning block 21. The protrusion posts 24 are penetrated through the sliding slot 911 that is located at a first side of the paper supporting plate 91. The protrusion posts 24 are aligned with the position sensing assembly 10. The protrusion posts 24 are movable along the sliding slot 911. The sliding track 22 is slidably connected between the paper supporting plate 91 and the carrier plate 11. The fixing elements 25 are penetrated through the sliding track 22 and tightened into the corresponding protrusion posts 24. After the fixing elements 25 are tightened into the corresponding protrusion posts 24, the sliding track 22 and the supporting slab 211 are connected with each other. Moreover, plural teeth 221 are formed on a lateral surface of the sliding track 22.

The roller 23 is located under the paper positioning block 21 and the paper supporting plate 91. The roller 23 is pivotally coupled to the sliding track 22. Consequently, the roller 23 is pivotally coupled to the paper positioning block 21 through the sliding track 22. As the paper positioning block 21 is moved, the roller 23 is correspondingly rolled through the sliding track 22. Consequently, the roller 23 is rolled along the carrier plate 11. The ratchet 26 is pivotally coupled to the paper supporting plate 91 and located under the paper supporting plate 91. The teeth 221 of the sliding track 22 are engaged with the teeth of the ratchet 26. A ring-shaped raised structure 261 is protruded from an outer surface of a side of the ratchet 26 away from the paper supporting plate 91. A bottom surface of the sliding track 22 is contacted with the ring-shaped raised structure 261. Consequently, the sliding track 22 is supported by the ring-shaped raised structure 261.

The linked positioning block 27 is installed on a side of the paper supporting plate 91 away from the position sensing assembly 10. The linked positioning block 27 also comprises plural linked protrusion posts (not shown). The linked protrusion posts are penetrated through the sliding slot 911 at the side away from the position sensing assembly 10. The linked sliding track 28 is slidably connected with the bottom side of the paper supporting plate 91. A bottom surface of the linked sliding track 28 is contacted with the ring-shaped raised structure 261. Moreover, plural teeth 281 are formed on a lateral surface of the linked sliding track 28. The teeth 281 of the linked sliding track 28 are engaged with the teeth of the ratchet 26.

Figure 4:
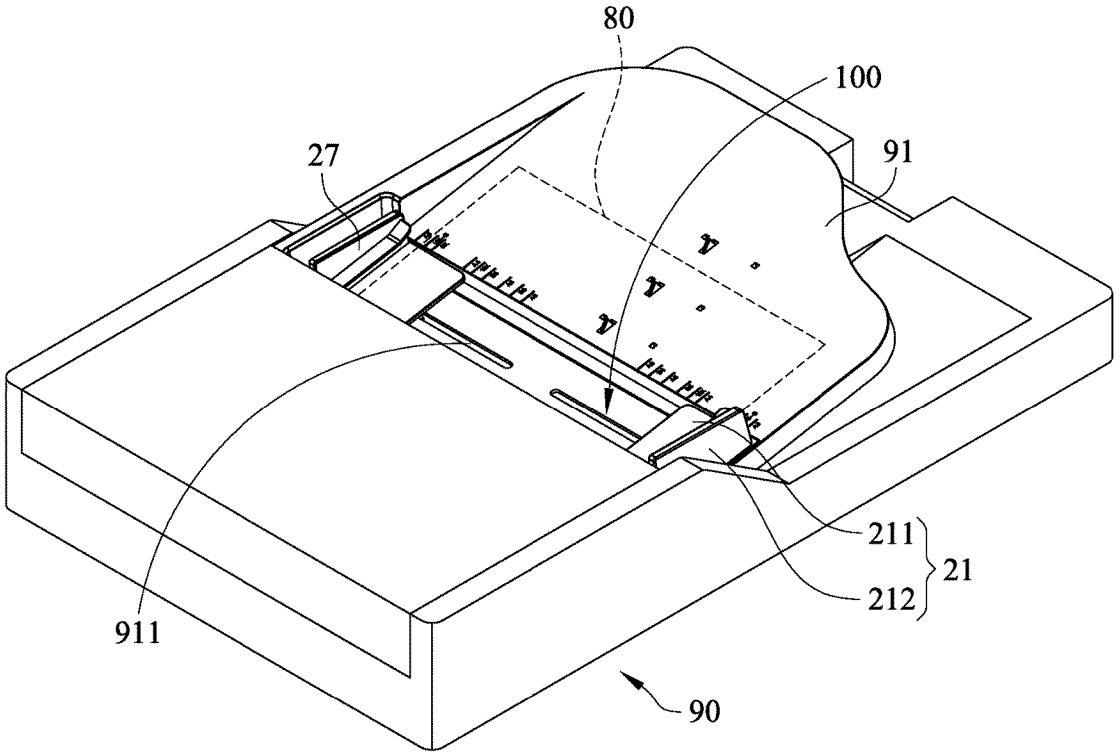
FIG. 4 is a schematic perspective view illustrating the paper size detection module in a usage state according to an embodiment of the present invention.

FIG. 4 is a schematic perspective view illustrating the paper size detection module in a usage state according to an embodiment of the present invention. Firstly, the user places a paper 80 on the paper support plate 91. Then, the paper positioning block 21 is moved in the direction toward the paper 80. Correspondingly, the sliding track 22 is moved in the direction toward the paper 80. Due to the engagement between the sliding track 22 and the ratchet 26, the ratchet 26 is correspondingly rolled. As the ratchet 26 is rolled, the linked sliding track 28 is correspondingly moved in the direction toward the paper 80. As the linked sliding track 28 is moved, the linked positioning block 27 is moved in the direction toward the paper 80 until the paper positioning block 21 and the linked positioning block 27 are respectively contacted with the two edges of the paper 80. While the paper positioning block 21 is moved in the direction toward the paper 80, the sliding track 22 is moved and the roller 23 is rolled with the movement of the sliding track 22. Consequently, the roller 23 is rolled along the carrier plate 11 and the pressed surfaces 141. When the vertical positioning plate 212 of the paper positioning block 21 is contacted with the paper 80 and a specified pressed surface 141 is pressed by the roller 23, the elastomer 14 corresponding to the specified pressed surfaces 141 provides a force or a pressure to the sensing circuit board 12. According to the position of the elastic element 14 which provides the force or the pressure, the sensing circuit board 12 generates a paper size signal. That is, when the position of the pressed surface 141 pressed by the roller 23 is detected by the sensing circuit board 12, the sensing circuit board 12 generates the corresponding paper size signal. After receiving the paper size signal from the sensing circuit board 12, the printer or the copier calculates the width size of the paper 80. Then, According to the width size, the printer or the copier selects the print paper with a suitable size from a paper input tray. Then, the contents of the paper document are printed out and printed on the print paper.

Since the width of the paper 80 is calculated according to the result of detecting the position of the pressed elastomer 14 by the sensing circuit board 12, it is not necessary to additionally install position sensors within the printer or the copier to detect the paper width. Consequently, the paper size detection module achieves the benefits of simplifying the structure, reducing the structural cost, saving the material cost and saving the structural space. Since the sensing circuit board 12 cooperates with the roller 23 and the elastomers 14 to detect the paper width, it is not necessary to additionally install sensors and the power-saving purpose is achieved. Moreover, as long as the number of the elastomers 14 is increased, the range of the paper width size can be expanded.

As mentioned above, the elastomers 14 are protruded from the resilience plate 13, and the resilience plate 13 is clamped between the sensing circuit board 12 and the carrier plate 11. Consequently, when the elastomers 14 are pressed by the roller 23, the elastomers 14 are not shifted. Under this circumstance, the elastomers 14 are not detached from the perforations 111 of the carrier plate 11.

As mentioned above, the sliding track 22 is supported by the ring-shaped raised structure 261 of the ratchet 26. Consequently, while the sliding track 22 is moved, the sliding track 22 is continuously moved along the same horizontal line. In other words, the sliding track 22 is not moved aslant.

From the above descriptions, the paper size detection module of the present invention has the following features. Firstly, the position sensing assembly 10 and the sliding block assembly 20 are used to achieve the function of detecting the width size of the paper 80. Secondly, since the information about the width size of the paper 80 is realized according to the result of detecting the position of the pressed elastomer 14 by the sensing circuit board 12, the paper size detection module can achieve the benefits of simplifying the structure, reducing the structural cost, saving the material cost and saving the structural space. Thirdly, since the resilience plate 13 is clamped between the sensing circuit board 12 and the carrier plate 11, the elastomers 14 are not shifted.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A paper size detection module installed on a paper supporting plate, the paper size detection module comprising:

a position sensing assembly located under the paper supporting plate, and comprising a carrier plate, a sensing circuit board and plural elastomers, wherein the sensing circuit board is installed on a bottom side of the carrier plate, first ends of the elastomers are connected with the sensing circuit board, and second ends of the elastomers are protruded out of the carrier plate and have corresponding pressed surfaces of the elastomers; and a sliding block assembly comprising a paper positioning block and at least one roller, wherein the paper positioning block is installed on the paper supporting plate, and the roller is located under the paper positioning block and the paper supporting plate, wherein the roller is connected with the paper positioning block and rolled along the carrier plate, wherein while the paper positioning block is moved, the roller is correspondingly rolled along the carrier plate and the pressed surfaces of the elastomers, wherein when a position of one of the pressed surfaces of the elastomers rolled and pressed by the roller is detected, the sensing circuit board generates a paper size signal.

2. The paper size detection module according to claim 1, wherein the sliding block assembly further comprises a sliding track, and the sliding track is slidably connected between the paper supporting plate and the carrier plate, wherein a bottom side of the paper positioning block is connected with a side of the sliding track, and the roller is rotatably coupled to the sliding track, so that the roller is rotatably coupled to the paper positioning block through the sliding track, wherein as the paper positioning block is moved, the roller is correspondingly rolled through the sliding track.

3. The paper size detection module according to claim 2, wherein the paper positioning block comprises a supporting slab and a vertical positioning plate, wherein the vertical positioning plate is protruded upwardly from the supporting slab, and the supporting slab is connected with the sliding track.

4. The paper size detection module according to claim 3, wherein the sliding block assembly further comprises plural fixing elements, wherein the fixing elements are penetrated through the sliding track and the supporting slab, so that the supporting slab is fixed on the sliding track through the fixing elements.

5. The paper size detection module according to claim 4, wherein the sliding block assembly further comprises plural protrusion posts, and the plural protrusion posts are protruded from a bottom surface of the supporting slab, wherein the paper supporting plate has a sliding slot, and the protrusion posts are penetrated through the sliding slot and movable along the sliding slot, wherein the fixing elements are tightened into the corresponding protrusion posts, so that the sliding track and the supporting slab are connected with each other.

6. The paper size detection module according to claim 2, wherein the sliding block assembly further comprises a ratchet, and the ratchet is pivotally coupled to the paper supporting plate and located under the paper supporting plate, wherein plural teeth are formed on a lateral surface of the sliding track, and the teeth of the sliding track are engaged with the ratchet.

7. The paper size detection module according to claim 6, wherein a ring-shaped raised structure is protruded from an outer surface of a side of the ratchet away from the paper supporting plate, and a bottom surface of the sliding track is contacted with the ring-shaped raised structure.

8. The paper size detection module according to claim 2, wherein the position sensing assembly further comprises a resilience plate, and the resilience plate is clamped between the sensing circuit board and the carrier plate, wherein the plural elastomers are protruded from the resilience plate, and the plural elastomers are connected with the sensing circuit board through the resilience plate.

9. The paper size detection module according to claim 8, wherein the carrier plate has plural perforations, wherein the plural elastomers are penetrated through and protruded out of the corresponding perforations, so that the pressed surfaces of the elastomers are exposed outside a top side of the carrier plate.

10. The paper size detection module according to claim 8, wherein the position sensing assembly further comprises plural fastening elements, and the plural fastening elements are penetrated through the sensing circuit board, the resilience plate and the carrier plate sequentially.

11. The paper size detection module according to claim 8, wherein the resilience plate and the plural elastomers are integrally formed, and the resilience plate and the plural elastomers are made of rubber, silicone or casting polyurethane.

12. The paper size detection module according to claim 9, wherein the plural elastomers are aligned with the corresponding perforations, and the plural elastomers and the plural perforations are linearly arranged.

* * * * *